United States Patent [19]

Abrioux et al.

[11] 4,196,826

[45] Apr. 8, 1980

[54] DISPENSING CONTAINER

[75] Inventors: André Abrioux, Drancy; Daniel Bauer, Le Raincy, both of France

[73] Assignee: L'Oreal, Paris, France

[21] Appl. No.: 688,840

[22] Filed: May 21, 1976

[51] Int. Cl.[2] ..... B67D 5/42; B65D 83/14

[52] U.S. Cl. ..... 222/136; 222/383; 222/386.5; 222/394

[58] Field of Search ..... 222/146 R, 146 C, 383–385, 222/320, 321, 405, 394, 135, 136, 145, 147, 386.5, 146 HA; 217/6, 25.5

[56] References Cited

U.S. PATENT DOCUMENTS

| | | | |
|---|---|---|---|
| 2,567,496 | 9/1951 | Pittenger | 222/383 X |
| 2,871,675 | 2/1959 | Cornelius | 222/146 C X |
| 3,401,843 | 9/1968 | Ahrens et al. | 222/321 X |
| 3,739,951 | 6/1973 | Geller et al. | 222/193 |
| 3,990,612 | 11/1976 | Gasser | 222/146 HA |
| 4,027,786 | 6/1977 | Ryckman | 222/146 HA |

*Primary Examiner*—F. J. Bartuska

*Attorney, Agent, or Firm*—Brisebois & Kruger

[57] ABSTRACT

Dispensing container comprises a chamber for holding a fluid to be dispensed in the form of a long, serpentine duct of small cross section.

9 Claims, 9 Drawing Figures

DISPENSING CONTAINER

SUMMARY OF THE INVENTION

Fluid products such as cosmetics are conventionally stored in cans or bottles which are provided with suitable dispensing means adapted to be actuated by the user in order to eject the products contained therein.

It has already been suggested that spray cans be used which contain products which are not under pressure and are equipped with a spray pump for manual reciprocation, said pump being connected to a depending tube positioned inside the chamber with which it is associated. This depending tube serves to direct the liquid contained in the chamber to the pump which ejects it. This type of packaging has the disadvantage that the product can be ejected only so long as the end of the depending tube is immersed therein. This is, however, not always the case, depending on the position in which the user holds the bottle. For example, if he turns the bottle upside down, the spray pump is positioned beneath the chamber and the end of the depending tube is no longer in contact with the liquid product, so that the pump is not supplied and the product cannot be distributed.

In order to assure the ejection of liquid products which are to be distributed in finely divided form, it has also been proposed to store them with fluid propellants in pressurized containers of the aerosol bomb type provided with an outlet valve.

The outlet valve generally cooperates with a depending tube and a pushbutton on which the user presses to open it and dispense the products contained in the pressurized container. The operation of this type of container likewise has the disadvantage that it cannot be carried out in all positions. Moreover, the fluid propellant which is incorporated in the pressurized containers is in general a hydrocarbon, preferably halogenated, in the liquid-vapor state at the temperatures of use, under a relatively low pressure of the order of several bars. The liquid phase of the fluid propellant is often mixed at least partially in the product to be distributed and it therefore exerts a dispersing force on the spray jet adapted to insure a distribution of the fine particles of the product being stored. Thus the fluid propellant serves, in this case, both the role of a vehicle for the product to be dispensed and that of a dispersing agent in the spray jet. When it is desired to use substances which are solely in the gaseous state, such as nitrogen for example, as the fluid propellant, in order to avoid any pollution of the atmosphere, it is found that at conventional storage pressures, defective vaporization takes place since the compressed gas serving as the propellant fluid does not exert a dispersive effect. The result is improved if the pressure on the propellant gas is increased, but in this case safety is impaired, because of the high pressure inside the container.

It is the object of the present invention to provide a chamber for storing liquid products which are not under pressure, which one wants to dispense especially in finely divided form, and which makes it possible to overcome the foregoing disadvantages. It is a further object of the present invention to provide a pressurized container in which the product to be dispensed is safely stored under a high pressure which may be as much as 100 bars, by means of a non-polluting gaseous propellant. This pressurized container permits the direct ejection of the product to be distributed in the form of a fine fog analogous to the one obtained at low pressure with the pollutant liquid-vapor propellants heretofore used. The invention also proposes to provide a simple solution to the delicate problems of packaging several liquid products in separate compartments when the liquids must not be brought into contact with each other until the moment at which they are dispensed.

It is also an object of the present invention to provide, as a new article of manufacture, a container comprising a chamber for storing at least one fluid product such as a cosmetic product for example, such chamber being adapted to be associated with at least one dispensing device which the user operates to cause dispensing, especially in a finely divided form, of the products contained therein, said chamber comprising at least one tubular duct having a small section and containing one of the products to be dispensed. The device is characterized by the fact that the outlet of the tubular duct communicates with the inlet of the dispensing means.

In a first embodiment of the container the tubular duct having a small section is a tube made in a single piece and wound, for example, around a mandrel.

In a second embodiment of the container the tubular duct having a small section is made of a bundle of tube segments which are substantially straight and parallel, said segments being connected to each other at their ends, by welding, for example. In these two embodiments the tubular duct or ducts in the chamber may be embedded in a mass of material, for example, resin.

In another embodiment the tubular duct or ducts having a small section may consist of a bundle of tube segments which are substantially straight and parallel and mounted in a block of solid material, said segments being connected to each other at their ends to form at least one serpentine tubular duct.

It should be noted that the container according to the invention makes it possible to solve in a simple manner the problem of storing inside several separate compartments liquid products which are not to be mixed until the moment of dispensing. It suffices to provide several tubular ducts of the same diameter or different diameters, each of these ducts being connected to the inlet of a single ejecting member.

The chamber may be made from at least one tube made of a plastic, glass, metal or rubber material which is wound about a mandrel. It is also possible to make the chamber from a bundle of sections of substantially straight and parallel tubing connected to each other at their ends, this bundle being mounted in a block of solid material such as glass, metal or synthetic resin, for example a polyacetyl resin commercially sold under the name of DELRIN by the Dupont Corporation or under the trademark ALCON by the ICI Corporation.

In a first embodiment of the container according to the invention the chamber formed from at least one tubular duct as above defined is associated with a manual ejection pump, said duct is connected at one end to the inlet of said pump and defines an unpressurized reservoir containing the liquid product to be distributed which is open to the ambient air through the end which is not connected to the pump, possibly through a valve. The liquid product contained in the tubular duct is advantageously isolated from the outer air by means of a small quantity of a non-volatile fluid which is immiscible with the liquid product to be dispensed.

It has been found that a container equipped with a chamber in the form of a tubular duct according to the invention serving as a reservoir for the liquid product which is to be dispensed may be used regardless of the position in which the user holds it. Since all the liquid is contained in at least one duct having a small section and substantial length opening into a pump of the conventional type, the latter is capable of displacing the liquid product so as to dispense it regardless of the position occupied by the container during the ejection. This distinguishes the invention from most of the dispensing devices of the prior art, in which the end of the depending tube which is not connected to the ejection device must necessarily be kept immersed in the liquid product to be dispensed at the time it is being dispensed. Thus an essential characteristic of the container according to the present invention is that it replaces, in the devices heretofore known, both the depending tube serving to direct the liquid to the ejecting means and the container serving as the reservoir for the liquid by means of a tubular duct having a small section and great length serving both these functions.

Because of the small section of the duct the liquid to be dispensed is retained in the tube by capillarity. The end of the tube which is not connected to the spray pump may thus be open, that is to say, in communication with the ambient air. The section of the duct is selected in dependence upon the liquid product to be stored. For example, a section of 3 mm in diameter is suitable for a liquid alcoholic fluid.

In a second embodiment a dispensing valve is associated with a chamber comprising at least one tubular duct as above defined so as to form a pressurized container of the aerosol bomb type, said chamber being adapted to contain both the product to be dispensed and at least one propellant fluid, the product to be dispensed being positioned in the duct between the dispensing valve and the fluid propellant. A separating piston, consisting of a liquid or solid material, may be inserted between the propellant fluid and the product to be dispensed. In the case in which the separating piston is a liquid product this separating liquid is immiscible with the product to be distributed and with the propellant fluid. The propellant fluid may be a compressed nonliquefied gas, such as nitrogen for example.

It has also been found that the pressurized container according to the invention is capable of operation regardless of the position in which the user holds it. An appreciable advantage resulting from this type of chamber is its ability to insure the storing of the products to be dispensed and their fluid propellant under a pressure much greater than that permitted in most of the pressurized containers heretofore used. In effect, the chamber is formed from at least one duct having a small section which offers a much greater resistance to explosion than containers or tubes of large section having walls of identical thickness. The reservoir which constitutes the duct may consequently safely contain fluid propellants at relatively high pressures of as much as 100 bars.

In a first variation of the second embodiment of the invention the chamber comprises at least one tubular duct which is connected at one of its ends to the dispensing valve and at its other end to a chamber of larger section than said duct, said chamber being adapted to contain the fluid propellant. The chamber is defined by a central core, for example a mandrel, about which the tubular duct is wound. The inner volume of the chamber is substantially cylindrical.

The invention also makes it possible to provide a container by providing a number of tubular ducts corresponding to the number of reservoirs required and connecting the ends of these ducts, as is already known, to a multiple valve provided for high pressures. However, the possibility then exists that a product may pass from one reservoir to the other at the moment of vaporization since, in each reservoir, the static equalibrium may be different from the dynamic equalibrium, by reason of the differences in diameter, viscosity and temperature. To reduce this disadvantage the ducts are advantageously connected to a single chamber containing the propellant fluid. In a second embodiment of the invention the pressurized chamber comprises several ducts, each constituting a reservoir containing a product to be dispensed, the ducts being connected at one of their ends to the dispensing valve and being connected together at their other ends where the fluid propellant is stored.

The fluid propellants used in the pressurized container according to the invention may be of various types. One may use substances in their liquid vapor state such as $CHF_3$, $CClF_3$, $CF_3Br$, $CHClF_2$, $CO_2$, $N_2O$ or a mixture of these constituents for example. It is also possible to use a substance such as carbon dioxide which is solely in the liquid phase in the chamber. It is also possible to introduce into the chamber a fluid propellant such as air, oxygen, $N_2O$, nitrogen, for example, found only in a gaseous phase inside said chamber.

The high pressure permitted by the chamber in the form of a duct having a small section is particularly valuable when it is desired to obtain distribution of the product in fine particles. The direct ejection of the product to be dispensed provoked by the compressed gas at a high pressure which may reach 100 bars produces a fine mist analogous to the one obtained at low pressure with a propellant fluid in the liquid vapor state used in a pressurized container of the conventional type.

Moreover, in most pressurized containers using compressed gas as well as a propellant fluid, the rate at which liquid is ejected is not constant and varies as a function of the pressure of the propellant gas which, in the range of pressures used, varies substantially with the extent of exhaustion of the product to be delivered contained in the container. On the contrary, with the pressurized chamber in accordance with the invention, the compressed gas is used over a range of pressures which make it possible to maintain the flow of the product being dispensed substantially constant. In order to do this the initial pressure of the compressed gas is regulated. That is to say, the pressure attained in the reservoir at the time of filling is at a value of the order of 100 bars and it is insured that the final pressure, that is to say, the pressure in the chamber after the ejection of all the products to be dispensed, remains sufficiently high, that is to say of the order of 15 bars.

It should be noted that this method of packaging is advantageous in that it does not lead to pollution of the atmosphere because the compressed gas used is nitrogen, air, carbon dioxide, or the like.

In order that the invention may be better understood, several embodiments thereof will now be described purely by way of illustration and example with reference to the accompanying drawings in which.

Figure 9:
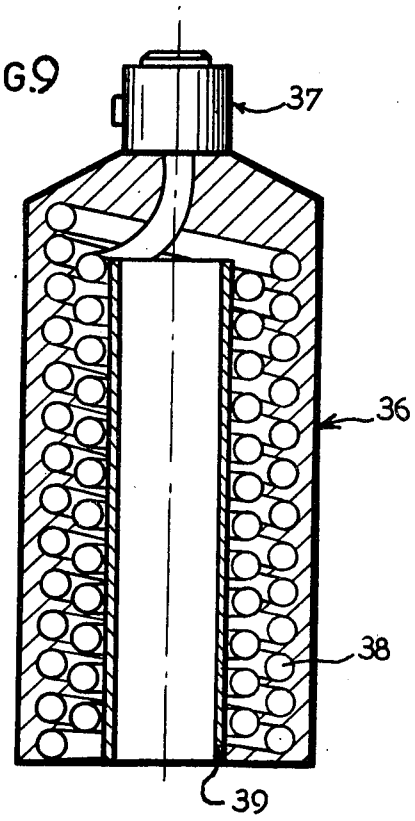
Figure 8:
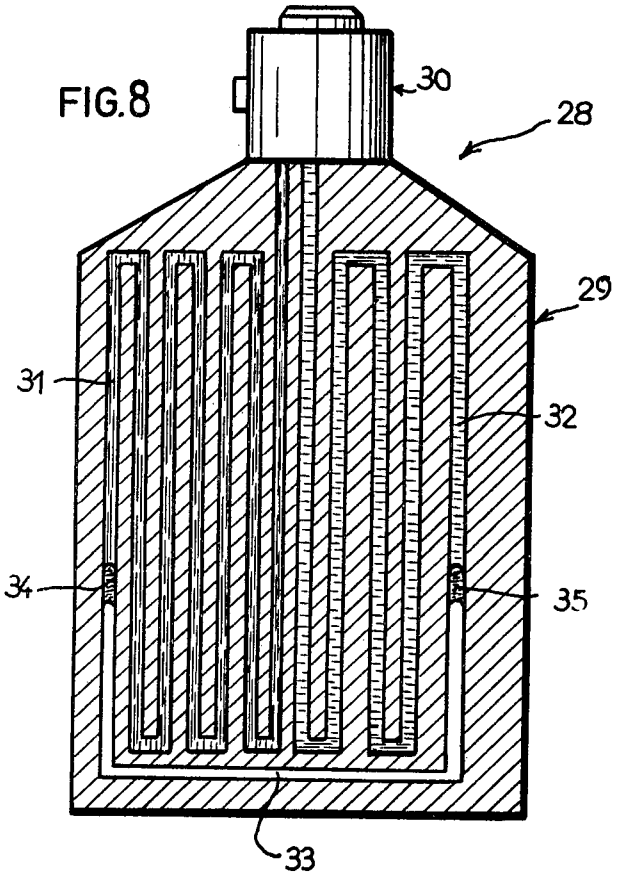
Figure 7:
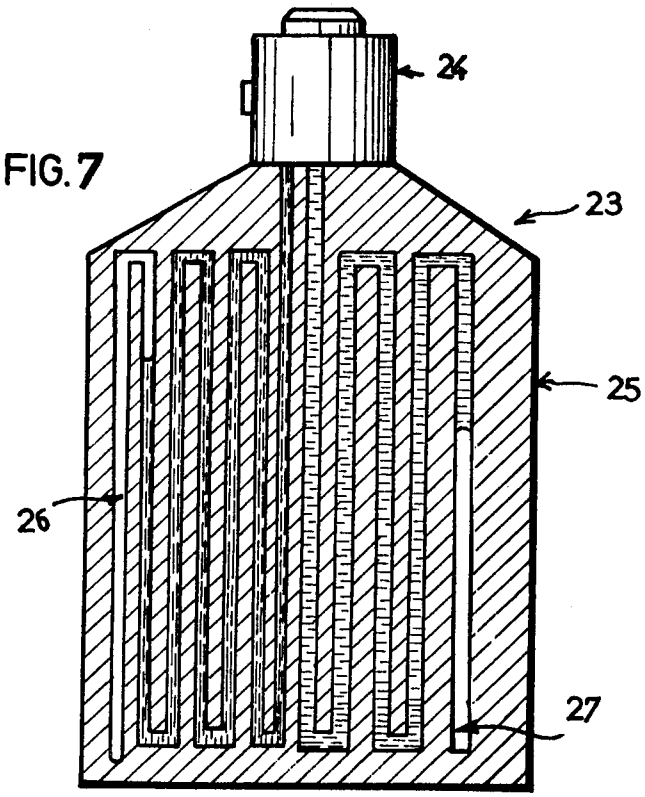
FIG. 7 is a schematic sectional view showing a pressurized container comprising two separate tubular ducts associated with a double flow valve so that the assembly constitutes a pressurized container of the aerosol bomb type.

FIG. 8 is a schematic sectional view showing an embodiment of the pressurized container of FIG. 7 in which the two ducts are connected to each other by those ends which are not connected to the double valve; and FIG. 9 schematically illustates a pressurized container comprising a tubular duct connected at one end to the dispenser and at its other end to a chamber adapted to contain the propellant fluid.

Figure 1:
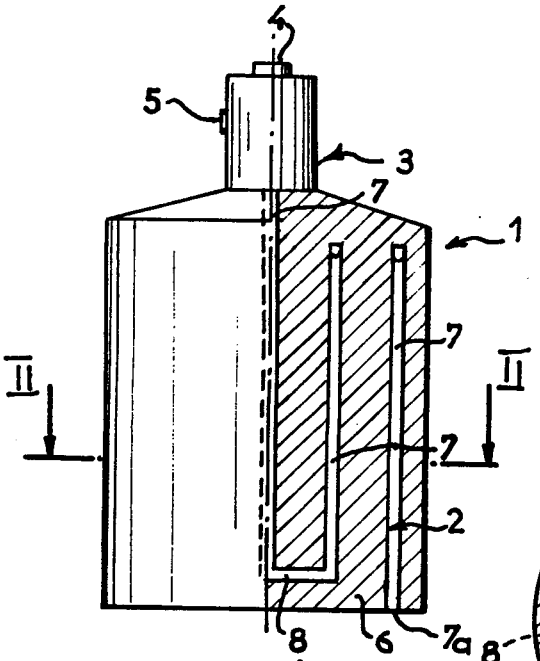
FIG. 1 is a schematic elevational view, partly in section along the line I—I of FIG. 2, showing an unpressurized chamber in the form of a tubular duct which cooperates with a manual spray pump to form a spray can.
Figure 2:
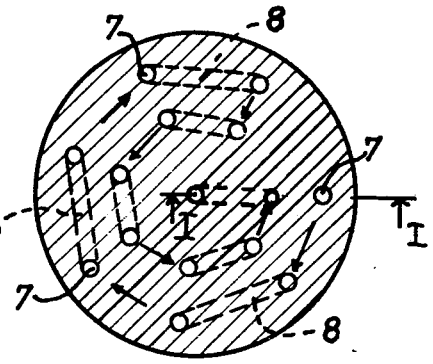
FIG. 2 is a schematic section taken along the line II—II of FIG. 1.

Referring now to FIGS. 1 and 2 it will be seen that reference numeral 1 designates the spray container as a whole. The container 1 comprises a chamber 2 in the form of a serpentine tube adapted to contain a liquid cosmetic product such as a lotion, lacquer, or perfume, as well as a spray pump 3.

The pump 3, not shown in detail, is of the conventional manually reciprocated type comprising an actuator 4. The pressure exerted by the user on the actuator 4 depresses the piston of the pump and causes the vaporization and discharge of a certain quantity of liquid contained in the chamber 2 through a spray nozzle 5.

The chamber 2 is a serpentine tube having a small section wound several times about itself. The serpentine tube having a right circular section consists, on the one hand, of a bundle of straight parallel tube segments 7 and, on the other hand, of a plurality of connecting passages 8 at the ends of the tube. The bundle of straight tube sections 7 is formed in a cylinder 6 made of a suitable material such as a resin, glass, metal or rubber, for example. The straight sections 7 are regularly positioned in concentric circles throughout the mass of the cylinder 6. The central straight section positioned along the axis of the cylinder 6 is connected to the spray pump 3. The end of the tube which is not connected to the spray pump 3 is open to the ambient air through an opening 7*a*. Between the opening 7*a* and the pump 3 the tube 1 consists of a succession of segments 7 and 8 as shown in FIG. 2. The segments 8 at the bottom of the container are shown in broken lines on FIG. 2. Segments 8 at the top of the container are schematically indicated by arrows on FIG. 2. The tube is thus wound about itself and about the axis of the cylinder 6.

In order to form the connecting parts of the tube 8 one may, as will be explained in greater detail in connection with the embodiment of FIG. 3, form in the zone of the cylinder 6 where two straight sections of the duct 7 terminate in a connecting passage in the form of a recess, the straight section of which corresponds substantially to a section of the tube, said recesses being then blocked by means of two circular plates which are adjusted in a fluid tight manner on each end of the cylinder 6. The chamber 2 in the form of a tube may consequently be made by assembling three members: first, the cylinder 6 provided with a bundle of straight tube segments 7, and then two plates mounted on opposite ends thereof, by welding, for example. The section of the tube is selected as a function of the liquid which it is desired to store. For example, a tube having a diameter of 3 mm is used when the liquid to be stored is based on alcohol. In this embodiment the liquid contained in the chamber 2 is at atmospheric pressure. In order to isolate the liquid to be dispensed from the outer atmosphere the serpentine tube may contain, near its opening 7*a*, a small quantity of liquid in contact with the air, this liquid being on the one hand, non-volatile, and on the other hand, immiscible with the product to be dispensed.

The spray container which has just been described may be used in any position, as distinguished from devices according to the prior art. The liquid to be dispensed is retained inside the chamber 2 and the pump 3 is always supplied with liquid.

The user may then, by reciprocating the actuator 4, vaporize the liquid stored inside the chamber 2.

Figure 3:
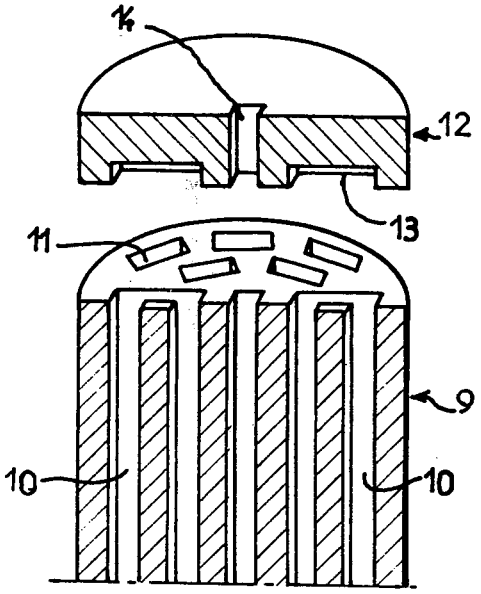
FIG. 3 is a view partially in perspective and partially in section showing another embodiment of a container according to the invention.

Referring now to FIG. 3 it will be seen that this shows a cylinder of solid material 9 in which straight tube segments 10 have been formed. These segments have a straight section and are parallel to each other and adapted to constitute, when connected together, a chamber in the form of a continuous tube. In order to save material and bulk it is desirable to provide as many straight tube segments 10 inside the cylinder 9 as possible, so as to have as small a wasted volume as possible, that is to say, so that the percentage of the volume of space defined by the segments 10 with respect to the total volume of the cylinder 9 is as large as possible.

The tube segments 10 are regularly positioned beside each other, and between two contiguous tube segments which are to be connected to each other straight grooves 11 are formed on opposite sides of the two end faces of the cylinder 9. Each groove 11 has a straight section which corresponds substantially to the half-section of a tube segment 10. In order to connect the various segments 10 to each other and form a continuous tube of great length a circular plate 12 is mounted on each of the two ends of the cylinder 9. In each end surface of the circular plates 12 which is to come in contact with an end surface of the cylinder 9, corresponding grooves 13 are provided, having the same dimensions as the grooves 11. In the upper circular plate 12 which has been illustrated a central duct 14 is also provided which is in alignment with the tube section 10 which extends along the axis of the cylinder 9 when the plate 12 has been mounted on said cylinder 9. The central duct 14 of the circular plate 12 is adapted to be connected to the inlet of a spray pump. When the plates 12 are adjusted on the two end surfaces of the cylinder 9, the grooves 13 connect to the grooves 11 to form tubes connecting the straight tube segments 10. This produces in a simple manner a chamber defining a very long serpentine tube and serves as a reservoir for the liquid product to be dispensed.

Figure 4:
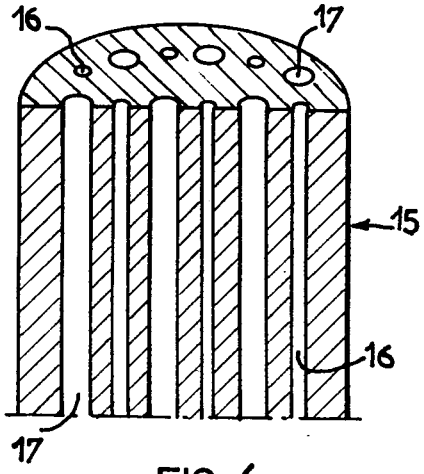
FIG. 4 is a view partially in perspective and partially in section of yet another embodiment of the container according to the invention.

FIG. 4 shows another embodiment of a chamber in the form of a serpentine tube. A bundle of straight tube segments is formed in a cylinder 15 of solid material. Ducts 16 having a circular section and ducts 17 having a larger section are regularly spaced throughout the mass of the cylinder 15. The ducts 16 may be connected to each other by passages to constitute a single tube. Ducts 17 may be connected to constitute another independent tube so as to form a chamber having two continuous tubes having a different internal section, in which two liquid products may be stored separately.

Figure 5:
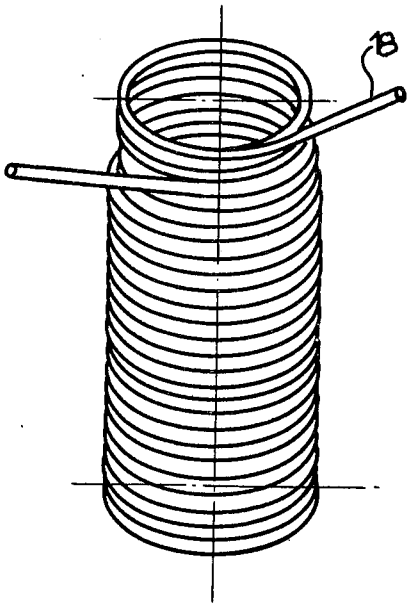
FIG. 5 illustrates an embodiment in which a chamber is formed by winding a tube about itself.

It is also possible to provide a chamber according to the invention by means of a continuous tube 18 which is wound, for example, about a mandrel, as illustrated in FIG. 5. This tube 18 may be made of any suitable material and preferably of a plastic material. After this operation, the tube 18 may be placed in a mold of appropriate shape so as to be embedded in a synthetic resin such as the resin commercially sold under the trademark DELRIN by the Dupont Company. Since the outer shape of the chamber is formed by a resin moulding, very diverse shapes for this chamber may be obtained which are attractive to the eye and need not be cylindrical, as is the case with most pressurized containers or spray containers used up to the present time.

Figure 6:
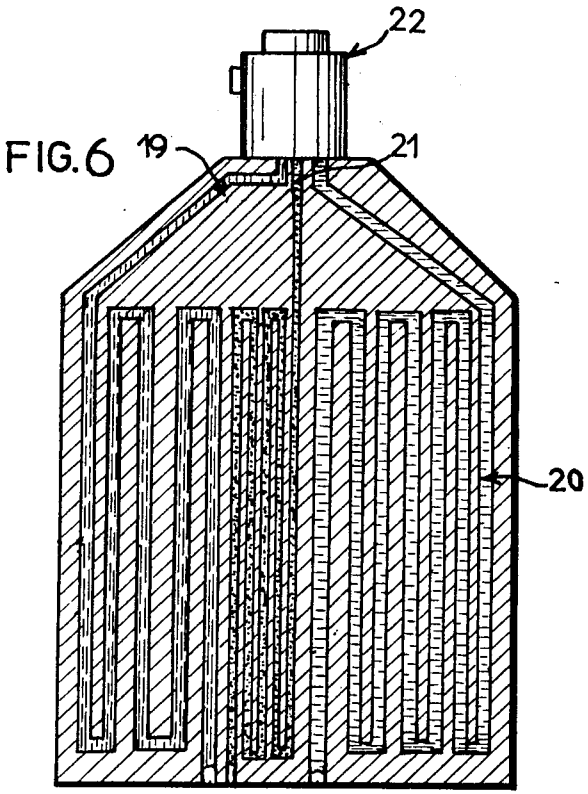
FIG. 6 is a schematic sectional view showing a chamber containing three separate tubular ducts associated with a spray pump so that the assembly constitutes a spray container.

Referring now to FIG. 6 it will be seen that this schematically shows an embodiment of a spray container according to the invention. The spray container comprises an unpressurized chamber adapted to store separately three liquids in three separate tubes 19, 20 and 21 which may have the same or a different diameter. The three liquids are not mixed until the moment at which they are dispensed. The three reservoirs 19, 20 and 21 are made, as already described, from a cylinder of solid material inside of which a plurality of straight tube segments are formed. It differs, however, from the chamber of FIG. 1, in that the straight tube segments are connected to each other by passages so as to form three separate tubes. The three separate reservoirs 19, 20 and 21 communicate with a spray pump 22 associated with the chamber. It will be noted that this embodiment of the chamber in the form of a tube offers a number of possibilities with respect to the arrangement of three reservoirs. It is possible to form the three separate tubes, for example, in three different circular sectors, or in cylinders of solid material positioned concentrically with respect to the axis of the chamber.

FIG. 7 shows a pressurized container of the aerosol bomb type indicated by reference numeral 23 and consisting of a pressurized chamber 25 connected to a double flow valve 24 of the conventional type. The chamber 25 is formed from two tubes defining two independent reservoirs 26 and 27 which may be of the same or a different diameter. The chamber is made as hereinbefore indicated except that the ends of the two tubes which are not connected to the valve are blocked. The tubular reservoirs hold the liquid cosmetic products, which are not to be brought into contact until the moment at which they are to be dispensed, as well as a fluid propellant, which is for example compressed nitrogen under high pressure. Each tube has a very small section, and offers great resistance to explosion. The pressure inside each reservoir in this example, after filling, and before any ejection of product, is of the order of 90 bars. The volume occupied by the compressed gas is substantially 1/6 of the volume of each reservoir and the nitrogen pressure after complete ejection of the products to be dispensed is of the order of 15 bars. It is arranged that the flow through the spray nozzle of the dispensing valve 24 is a turbulent flow and under these conditions there is obtained for this range of pressures a rate of product flow which is substantially independent of the pressure prevailing inside each tube. In the course of operation it has also been found that the spray jet is in the form of a mist of very fine particles analogous to those obtained in a pressurized container utilizing a propellant fluid in the liquid vapor phase.

FIG. 8 shows a pressurized container of the aerosol bomb type indicated by reference numeral 28 and comprising a pressurized chamber 29 associated with a double flow valve 30. The pressurized chamber 29, in the form of a serpentine tube, is adapted to insure the separate storage of two products 31 and 32, which are to be mixed only at the moment they are dispensed, as in the case of the pressurized container of FIG. 7, except that the two tubes are in this case connected at those ends which are not connected to the valve. The propellant fluid 33 which, in this example, is carbon dioxide in liquid phase, is inserted between the two products to be vaporized 31 and 32. A small quantity of a separating liquid respectively 34, 35 is positioned between the fluid propellant 33 and the two liquids 31 and 32 to be vaporized. The separating liquid is not immiscible with the propellant fluid or with the two products 31 and 32.

This embodiment makes it possible to provide, in the two compartments, a strictly equal pressure and thus avoid the passage of liquid product 32 into the compartment containing the liquid 31 and vice versa, at the moment spraying takes place.

Referring now to FIG. 9 it will be seen that this shows a pressurized container comprising a chamber 36 which cooperates with a dispensing valve 37. The chamber 36 is made from a tube 38 of plastic material wound around a mandrel 39. The mandrel 39 defines a cylindrical chamber communicating with one end of the tube 38. The assembly comprising the mandrel 39 and tube 38 is embedded in a synthetic resin, for example a polyacetyl resin which constitutes the outer container for the chamber 36. The free end of the tube 38 is connected to the inlet of the dispensing device 37. The chamber defined by the mandrel 39 is adapted to contain the fluid propellant, for example $CF_3Br$ in equilibrium between its liquid and vapor phase. The cosmetic product to be dispensed, such as a hair lacquer, is adapted to be positioned in the zone of the tube which opens into the dispensing device. It has been found that this pressurized container is adapted to function in all positions in which it may be placed by the user.

It will, of course, be appreciated that the embodiments which have just been described have been given purely by way of illustration and example and may be modified as to detail without thereby departing from the basic principles of the invention. In particular the container according to the invention may be used to hold cosmetic products, hair treating products, insecticides, housekeeping products, or pharmaceutical products, and the container according to the invention may also be used to store a gas under pressure.

What is claimed is:

1. A dispensing container for storing at least one fluid product comprising, at least one manually operable dispensing device for dispensing the product in finely divided form, and capillary duct means consisting essentially of the sole means for storing the product in the container, said capillary duct means having an outlet connected to the inlet of the dispensing device, and in which said capillary duct means comprises a bundle of substantially straight capillary tube segments parallel to each other and connected to each other at their ends.

2. A dispensing container for storing at least one fluid product comprising, at least one manually operable dispensing device for dispensing the product in finely divided form, and capillary duct means consisting essentially of the sole means for storing the product in the container, said capillary duct means having an outlet connected to the inlet of the dispensing device, and in which said capillary duct means comprises a bundle of substantially straight parallel tube segments formed in a block of solid material, said segments being connected to each other at their ends.

3. Container comprising a chamber for storing at least one fluid product, said chamber being adapted to be associated with at least one manually operable dispensing device for dispensing the product in finely divided form, said chamber consisting essentially of at least one duct having a small cross section containing a product to be dispensed, the outlet of said duct being connected to the inlet of the dispensing device, in which the chamber is associated with a manual ejecting pump, said duct is connected at one end to the inlet of said pump and forms an unpressurized reservoir containing a liquid to be dispensed, the end of said duct which is not connected to said pump being in communication with the ambient atmosphere, and in which the liquid to be dispensed contained in the duct is isolated from the ambient air by a small quantity of a non-volatile fluid immiscible with said liquid product, in the end of said duct.

4. A dispensing container for storing at least one fluid product comprising, at least one manually operable dispensing device for dispensing the product in finely divided form, and capillary duct means consisting essentially of the sole means for storing the product in the container, said capillary duct means having an outlet connected to the inlet of the dispensing device, and in which said dispensing device comprises a dispensing valve, and said capillary duct means contains both the product to be dispensed and at least one propellant fluid, the product to be dispensed being positioned in the capillary duct means between the dispensing valve and the propellant fluid.

5. Container as claimed in claim 4 further comprising separating means in said capillary duct means between the fluid propellant and the product to be distributed for separating the product from the propellant.

6. Container as claimed in claim 5 in which the separating means comprises a liquid which is immiscible with the product to be dispensed and the fluid propellant.

7. Container as claimed in claim 4 in which the propellant fluid is a compressed non-liquefied gas such as nitrogen.

8. Container as claimed in claim 4 in which said capillary duct means comprises several tubular capillary ducts, each constituting a reservoir containing a product to be dispensed, said ducts being connected at one of their ends to the dispensing valve and being connected to each other at their other ends.

9. A dispensing container for storing at least one fluid product comprising, at least one manually operable dispensing device for dispensing the product in finely divided form, and capillary duct means consisting essentially of the sole means for storing the product in the container, said capillary duct means having an outlet connected to the inlet of the dispensing device, and wherein, said dispensing device is a manual ejecting pump, said capillary duct means includes a capillary duct communicating with ambient atmosphere and comprises an unpressurized means for storing the product in the container, and in which said capillary duct means comprises a capillary duct imbedded in a mass of resinous material.

* * * * *